US006321647B1

(12) United States Patent
Gable

(10) Patent No.: US 6,321,647 B1
(45) Date of Patent: Nov. 27, 2001

(54) PERFORATING MACHINE

(76) Inventor: Derek J. Gable, 7246 Avenida Altissima, Rancho Palos Verdes, CA (US) 90274

( * ) Notice: Subject to any disclaimer, the term of this patent is extended or adjusted under 35 U.S.C. 154(b) by 0 days.

(21) Appl. No.: 09/504,137

(22) Filed: Feb. 15, 2000

Related U.S. Application Data

(60) Provisional application No. 60/120,251, filed on Feb. 16, 1999.

(51) Int. Cl.[7] ..... B26F 1/00; B26F 1/02; B26F 1/38

(52) U.S. Cl. ..... 101/19; 83/73; 83/76.1; 463/30

(58) Field of Search ..... 446/9, 79; 472/72; 101/19; 83/76.9, 76.1, 73; 463/30

(56) References Cited

U.S. PATENT DOCUMENTS 3,654,880 * 4/1972 Schesso ..... 109/25
3,929,254 * 12/1975 Artze ..... 221/30
5,662,202 * 9/1997 Suris ..... 194/206

FOREIGN PATENT DOCUMENTS 1-152594 * 6/1989 (JP) .

* cited by examiner

*Primary Examiner*—Daniel J. Colilla
(74) *Attorney, Agent, or Firm*—Allen A. Dicke, Jr.

(57) ABSTRACT

The novelty perforating machine perforates paper, such as paper money and similar paper or paperlike sheet material, in a manner that the original purpose of the paper is not lost, but when it is held to the light, a light pattern representing the novelty is seen. Thus, a paper money bill can be perforated with a selected pattern to form a novelty item, such as an outline picture of the area in which the perforating machine is situatuated.

19 Claims, 3 Drawing Sheets

PERFORATING MACHINE

CROSS REFERENCE

This application claims priority benefit under 35 USC 119(e) of US Provisional Application 60/120,251 filed Feb. 16, 1999.

FIELD OF THE INVENTION

This invention is directed to a machine which perforates paper, such as paper money and similar paper or paperlike sheet material, in a manner that the original purpose of the paper is not lost, but when it is held to the light, a light pattern representing the novelty is seen. Thus, a paper money bill can be perforated with a selected pattern to form a novelty item, such as an outline picture of the area in which the perforating machine is situated.

BACKGROUND OF THE INVENTION

Paper currency is a well known monetary medium, and is the intention of this invention to utilize common paper currency and change it into a novelty without destroying the paper money value thereof.

Deforming coinage into novelties is known, but when so deformed, the coinage no longer has its monetary value. Perforating is known, but perforating paper monetary units such as dollar bills to add the function of being a novelty item, is new.

SUMMARY OF THE INVENTION

In order to aid in the understanding of this invention, it can be said in essentially summary form that it is directed to a novelty perforating machine wherein one or more cutters are actuated at the same time or successively to perforate a pattern of holes in a paper monetary unit so that the perforations therein create a novelty pattern without destroying the monetary value.

It is thus a purpose and advantage of this invention to provide a novelty perforating machine which perforates a pattern of holes in a paper monetary unit so that the paper monetary unit becomes a memorabilia in novelty as well as paper money.

It is another purpose and advantage of this invention to punch a series of holes in a paper monetary unit by moving a single cutter relative to the paper monetary unit to successively cut the holes.

It is another purpose and advantage of this invention to have such a perforating machine which has a memory therein which provides control of perforating to perforate any one of a selected group of holes representing different memorabilia so that the same perforating machine and setup can do the perforating of different punch patterns to represent different memorabilia.

It is a further purpose and advantage of this invention to provide a novelty perforating machine which has a plurality of punches therein so that, when selected ones of the plurality of punches are actuated, they reduce the memorabilia of punch pattern holes in one stroke.

It is another purpose and advantage of this invention to provide a novelty perforating machine which does not require the addition of supplies thereto because the buyer of the novelty memorabilia supplies his own material, preferably in the form of paper money, to serve as the carrier for the memorabilia.

Other purposes and advantages of this invention will become apparent from a study of the following portion of the specification, including the drawings, specification and claims.

DESCRIPTION OF THE PREFERRED EMBODIMENTS

Figure 1:
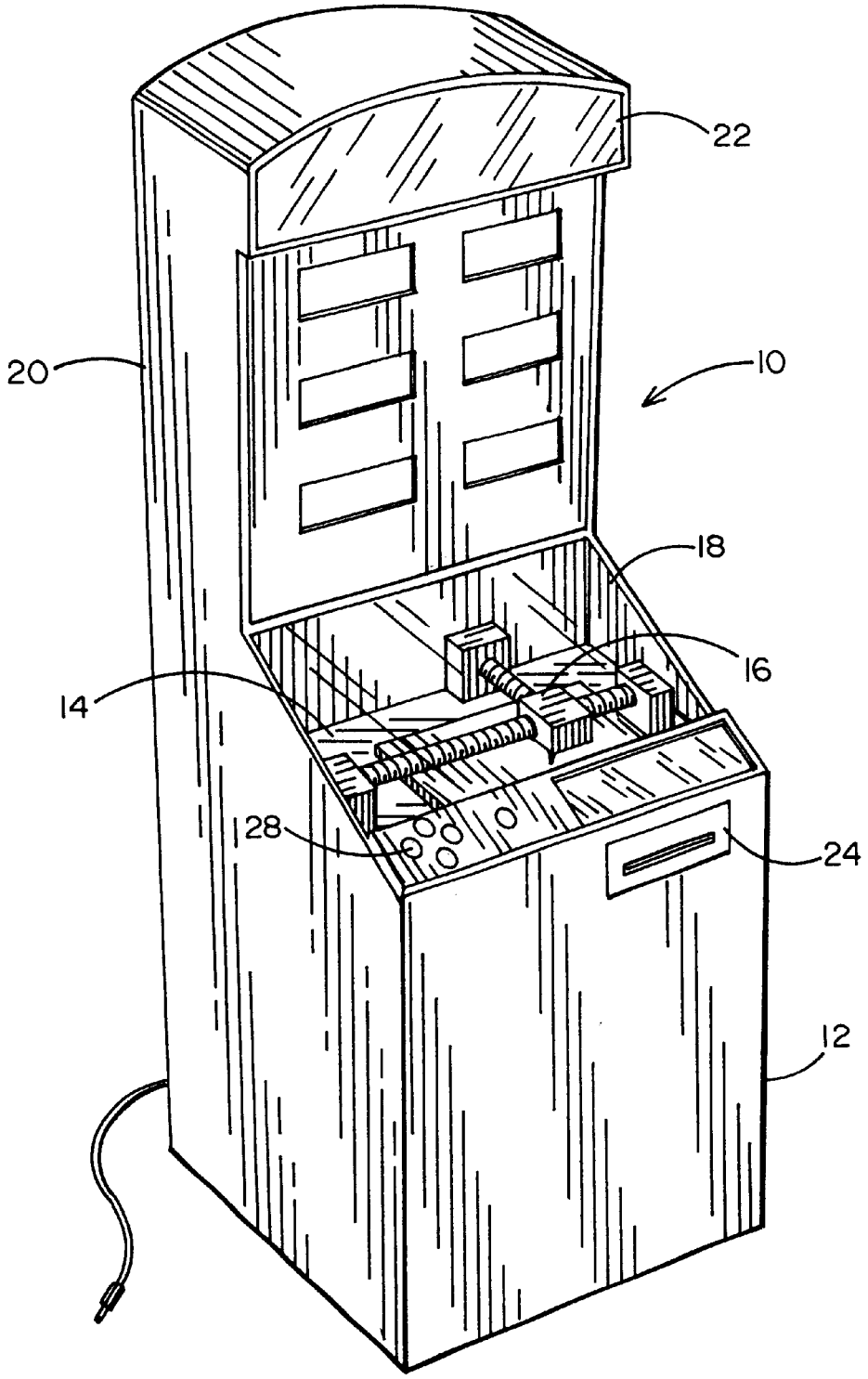
FIG. 1 is an isometric view of a first preferred embodiment of the novelty perforating machine.

FIG. 1 is a perspective view of a preferred embodiment of the novelty perforating machine of this invention wherein it is generally indicated at 10. The machine has a base 12 which includes various mechanisms and controls. The top of the base terminates at top surface 14 on which some of the mechanism 16 is located so that the user of the machine can observe its operation. Transparent cover 18 protects the mechanism. Back panel 20 is mounted on base 12 and extends at least up to eye level to attract potential customers. Attention attracting devices such as lights 22 are mounted on the back panel to attract customers. Other attracting devices such as colorful signs or sound can also or alternatively be employed.

Figure 4:
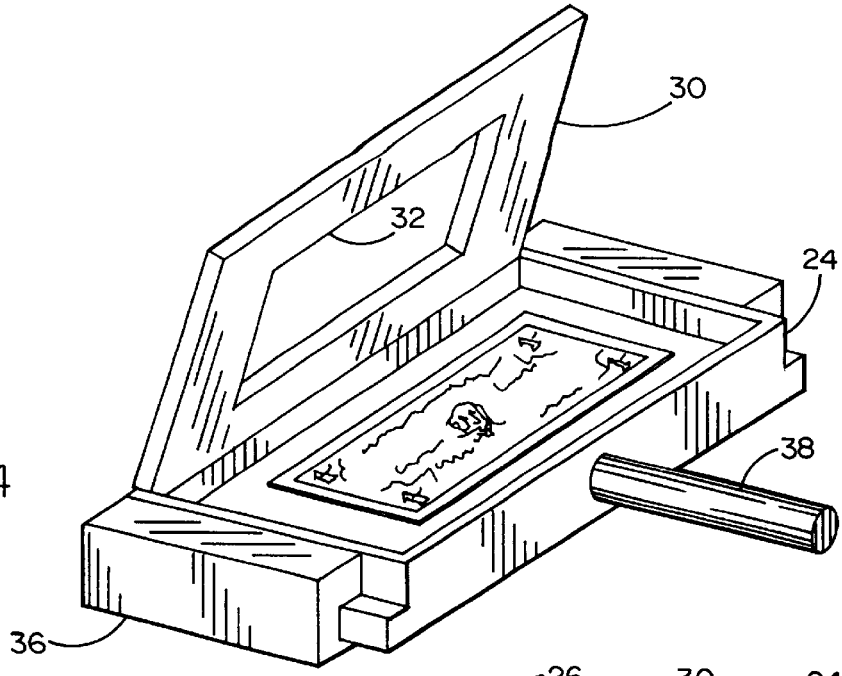
FIG. 4 is a view of the bill carrier in the open position.

The purpose of the machine 10 is to receive paper money, such as a dollar bill, and perforate it. Paper money acceptor 24 is mounted on the front of the machine and opens so that paper money, such as dollar bill 26 can be placed therein (see FIG. 4). The paper money acceptor also serves as a carrier which moves the dollar bill into the operative position in the machine. The base 12 also carries a coin acceptor 28 of conventional style so that a coin may be inserted to actuate the mechanism 16 of the machine.

Figure 2:
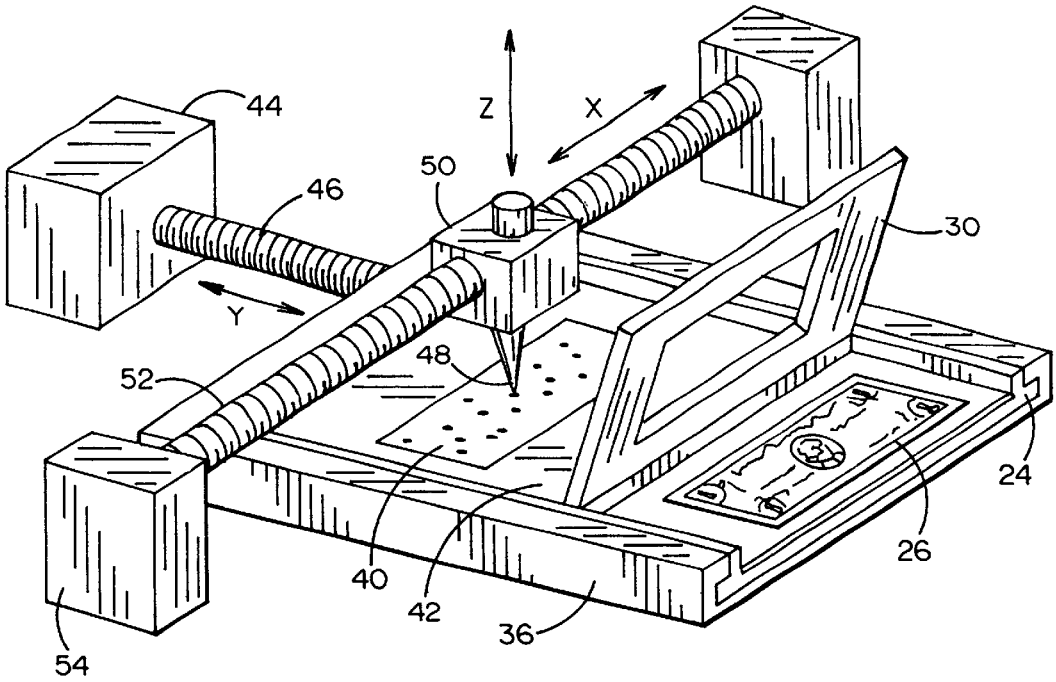
FIG. 2 is an isometric view of the X-Y positioning assembly within the machine case of FIG. 1.
Figure 3:
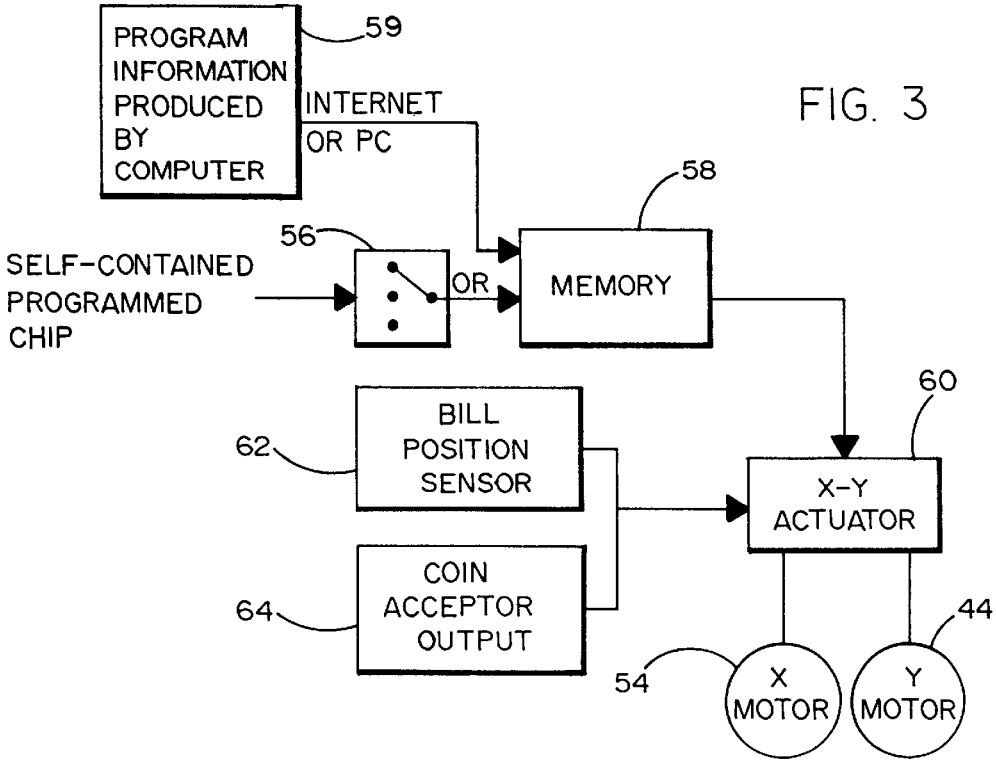
FIG. 3 is an electrical schematic of a preferred X-Y driver.
Figure 5:
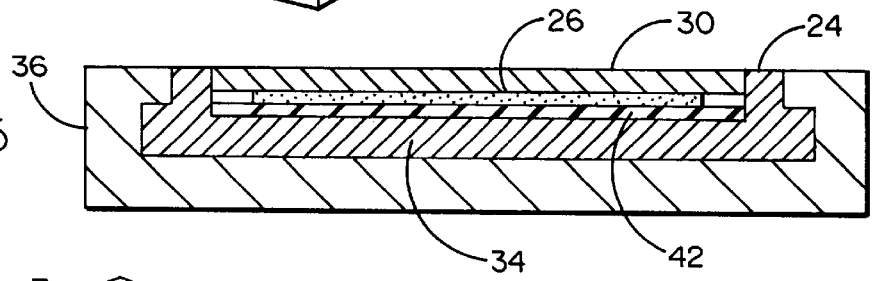
FIG. 5 a view of the bill carrier fully inserted into the X-Y platform.

As seen in FIG. 5, the paper money carrier 24 is dovetail shaped. It is pulled out in FIG. 4, and the cover 30 is open. The cover 30 has an opening 32 therein. The support plate 34 under the paper money 26 also has an opening therein in which is positioned backup material 42. The support plate 34 is secured to the two dovetail guides on each side of the paper money carrier. In FIG. 2, the front of the paper money carrier 24 is shown open and even with the front of platform 36 into which it slides. In use, the dollar bill 26 is put in place, and the cover 30 is closed thereon to clamp the dollar bill around the edges. Handle 38 is used to thrust the carrier 24 back in its dovetails in the platform 36. When it is fully inserted, it is locked in place and is over the phantom area 40, which is the active area of perforation. The base 42 under the active area is of suitable material to cooperate with a punching stylus, such as a hard rubber mat.

Positioning motor 44 is connected to position the front-to-back location of the platform 36, such as through screw 46. The perforator 48 is carried on perforater carrier 50, which is mounted for movement in the X direction on screw 52. X-motor 54 drives the screw. Perforator 48 may be a mechanical punch with a backup die or with a resilient backup mat. Perforator 48 may be a laser cutter, in which case the backup is open or laser resistant.

The positioning of the perforator can be selected to choose a desired pattern of perforations. For example, the buyer of the novelty memorabilia may have a selection of different perforating configurations which form the memorabilia. A selector switch 56 can choose a selected configuration from memory 58. The memory 58 can be updated from computer 59 which can be remotely programmed. The memory 58 supplies the position information to X-Y actuator 60, which actually appropriately drives the motors. In the usual system, position correction feedback is also employed. In order to assure that all is in order to begin perforation, a paper money sensor 62 and a coin acceptor output 64 are connected to the actuator 60 so that the system can operate only when these conditions are also met.

The buyer of the novelty perforated money places his bill 26 in position and closes the cover 30. He moves the carrier 24 into position. He selects the perforating configuration and places a coin in the acceptor 28. It is thus ready for perforation. The perforator carrier 50 moves to position, and its perforator 48 is actuated to perforate a small hole into the bill 26. Successive repositionings, in accordance with the selected pattern program from memory 58, of the perforator carrier 50 together with the perforator 48 provide the perforated pattern in the bill, which thereupon serves as memorabilia. When perforating is done, the paper money can be removed from the machine for retention.

Figure 6:
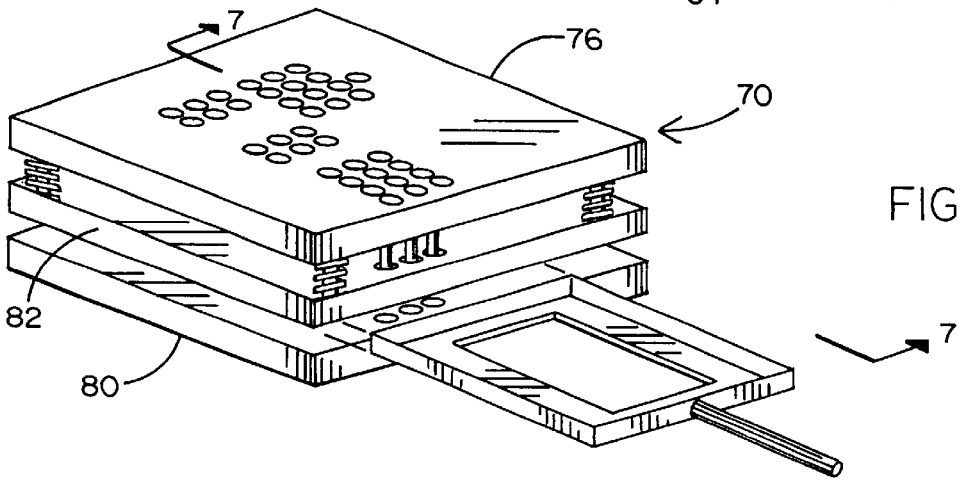
FIG. 6 is an isometric view of another embodiment of the punching mechanism wherein a plurality of punches are simultaneously employed.
Figure 7:
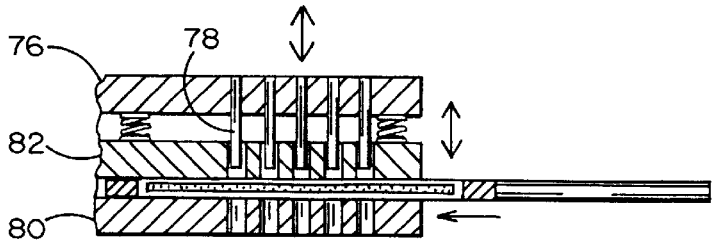
FIG. 7 is a sectional view, with parts broken away and parts taken in section, as seen generally along line 7—7 of FIG. 6.

The perforating machine 10 of FIGS. 1 through 5 is one example of the manner in which the novelty perforations can be accomplished in the paper money to create a memorabilia item. In that example, a single mechanical punch or laser perforator is employed, and the paper money is moved laterally with respect to the perforator for successive perforations. In FIGS. 6 and 7, the perforation is accomplished by a perforator 70 by which a plurality of perforations are accomplished at the same time. A piece of paper money 72 is inserted into carrier 74. The carrier with the paper money is thrust into the perforator 70. The perforator comprises three parallel plates. The top plate is pin carrier 76, which carries a plurality of pins 78 (see FIG. 7). The pins are aligned with the holes in die plate 80. Thus, when the paper money 72 is positioned therebetween, the pin carrier is brought down with respect to the die plate to punch out holes where there are pins 78. The pins are positioned so as to create a memorabilia image in the money 72. When the pins are raised out of the paper money 72, they are withdrawn through stripper plate 82 to pull the punch pins free of the paper money. When the pin carrier 76 is returned to its upper position after the punching, the carrier 74 can be withdrawn and the paper money removed.

The memorabilia or perforated novelty has a configuration which corresponds to the number of active punch pins 78. The pin carrier 76 may be generic and have punch pins inserted only into those holes where punching is desired. On the other hand, for each punching operation, those pins for which punching is required may be individually selected, in accordance with the manner in which the pins are mounted or driven. Perforations may be made in dollar bills and other paper money in selected patterns which create memorabilia.

This invention has been described and it is presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A novelty perforating machine comprising:

a paper acceptor for receiving paper and positioning it by a depositor within said machine;

a perforating mechanism for perforating a plurality of holes in the paper in the form of a selected novelty representation so that the form may be viewed by the depositor when the paper is held to the light;

a coin acceptor for accepting a coin to energize said machine when the paper is in place; and delivery structure for delivering the perforated paper back to the depositor of the paper.

2. The novelty perforating machine of claim 1 wherein there is a plurality of perforators positioned adjacent the deposited paper and at least the selected group of said perforators is advanced to perforate the paper in the selected novelty pattern.

3. The novelty perforating machine of claim 1 wherein there is a paper carrier and the paper is paper money which is deposited into and retained in the carrier and said perforator comprises a laser cutter together with a positioning mechanism for successively positioning the paper money with respect to said laser cutter while repeatedly actuating the laser cutter to cut successive holes in the paper money.

4. The novelty perforating machine of claim 1 wherein there is a paper carrier and the paper is paper money which is deposited into and retained in the carrier and said perforating mechanism comprises a single punch together with positioning mechanism for successively positioning the paper money with respect to the single punch while repeatedly actuating the punch to punch successive holes in the paper money.

5. The novelty perforating machine of claim 4 wherein the paper money carrier is successively positioned on different substantially rectangular coordinates while the perforating punch is actuated on a coordinated substantially right angle with respect to the paper money carrier positioning coordinates.

6. The novelty perforating machine of claim 5 wherein there is a memory and said memory is connected to said positioning mechanism so that the pattern of perforated holes is determined by memory information.

7. The novelty perforating machine of claim 6 wherein there is a plurality of different punch patterns in said memory and any one of said plurality of punch patterns may be selected for positioning said punch with respect to said paper bill.

8. The novelty perforating machine of claim 1 wherein said perforator comprises a single perforator punch together with a positioning mechanism for successively positioning the paper with respect to the single punch while repeatedly actuating the punch to punch successive holes in the paper.

9. The novelty perforating machine of claim 3 wherein the paper money carrier is successively positioned on different coordinates while the laser cutter is successively actuated.

10. The novelty perforating machine of claim 9 wherein there is a memory and said memory is connected to said positioning mechanism so that the pattern of perforated holes is determined by memory information.

11. The novelty perforating machine of claim 1 wherein:

there is a carrier to receive the paper and said punch is positioned with respect to said carrier;

X and Y positioning motors are connected to said carrier and to said perforating mechanism to position said perforating mechanism on X and Y axes with respect to the paper and said carrier, said perforating mechanism being actuated along a Z-axis substantially at a right angle to said X and Y axes when said perforating mechanism is in a selected position with respect to said carrier.

12. A novelty perforating machine for perforating a memorabilia pattern into a paper money bill comprising:

a bill carrier to receive the paper money bill and hold it in place with respect to said bill carrier; a perforator for perforating successive holes into the paper money bill on a pattern which represents memorabilia;

X and Y positioning drive mechanisms connected to said perforator and to said bill carrier for positioning said perforator with respect to said bill carrier on X and Y-axes to specific points on the X-Y axes;

a perforator drive structure for actuating said perforator to perforate holes in the paper money bill in the carrier; and a coin acceptor for signalling the start of perforating and positioning so that when coins are put into said coin acceptor the bill is perforated in accordance with the memorabilia perforating pattern.

13. The novelty perforating machine of claim 12 wherein there is a memory connected to said X and Y-axis drive mechanism so that the sequential positioning of the punch is positioned in accordance with memory information and there is interconnection between the X and Y-axis positioning mechanism and the perforator drive structure so that the perforator drive structure is only actuated when the perforator is positioned as selected by said memory.

14. The novelty perforating machine of claim 12 wherein said perforator comprises a laser cutter together with a positioning mechanism for successively positioning the paper money with respect to said laser cutter while repeatedly actuating the laser cutter to cut successive holes in the paper money.

15. The novelty perforating machine of claim 14 wherein said laser cutter is actuated on a Z-axis which is substantially at a right angle with respect to both said X and Y-axes and is substantially at a right angle to the surface of a paper money bill retained in said bill carrier.

16. The novelty perforating machine of claim 12 wherein said perforator is enclosed in a transparent protective cover on said machine so that when the paper money bill is positioned in said bill carrier and said bill carrier is positioned with respect to said perforator, sequential perforating is visible to the depositor.

17. The novelty perforating machine of claim 16 wherein said coin acceptor has a coin acceptance slot exterior of said machine so that the depositor can deposit coins therein to actuate said perforating machine.

18. The novelty perforating machine of claim 16 wherein said machine has an upstanding back panel at eye level to attract attention to the machine.

19. The novelty perforating machine of claim 12 wherein said machine has an upstanding back panel at eye level to attract attention to the machine.

* * * * *